US007314088B2

(12) United States Patent
Betts et al.

(10) Patent No.: US 7,314,088 B2
(45) Date of Patent: Jan. 1, 2008

(54) SYSTEM FOR RETRIEVING A TUBULAR ELEMENT FROM A WELL

(75) Inventors: Michael John Betts, Rijswijk (NL); Michael Edward Pointing, Rijswijk (NL)

(73) Assignee: Shell Oil Company, Houston, TX (US)

( * ) Notice: Subject to any disclaimer, the term of this patent is extended or adjusted under 35 U.S.C. 154(b) by 147 days.

(21) Appl. No.: 10/476,633

(22) PCT Filed: Apr. 26, 2002

(86) PCT No.: PCT/EP02/04854

§ 371 (c)(1),
(2), (4) Date: May 14, 2004

(87) PCT Pub. No.: WO02/088517

PCT Pub. Date: Nov. 7, 2002

(65) Prior Publication Data

US 2004/0194962 A1 Oct. 7, 2004

(30) Foreign Application Priority Data

Feb. 5, 2001 (EP) ..... 01304024

(51) Int. Cl.
*E21B 29/12* (2006.01)

(52) U.S. Cl. ..... 166/368; 166/359; 166/345; 166/340; 166/281

(58) Field of Classification Search ..... 166/359, 166/340, 344, 345, 350, 361, 365, 367, 368, 166/377–381, 277
See application file for complete search history.

(56) References Cited

U.S. PATENT DOCUMENTS 3,139,141 A * 6/1964 Fredd et al. ..... 166/208
3,332,492 A * 7/1967 Thomas ..... 166/55.1
3,376,923 A 4/1968 Bullard
3,391,735 A * 7/1968 Schramm et al. ..... 166/359
3,800,869 A * 4/1974 Herd et al. ..... 166/337
4,189,003 A * 2/1980 James et al. ..... 166/386
4,448,266 A * 5/1984 Potts ..... 175/7
4,702,320 A * 10/1987 Gano et al. ..... 166/343
4,730,677 A 3/1988 Pearce et al.
4,732,214 A * 3/1988 Yates ..... 166/336
5,080,173 A 1/1992 Brammer
5,513,570 A 5/1996 Mulcahy
5,544,707 A * 8/1996 Hopper et al. ..... 166/382
5,960,885 A * 10/1999 Edwards et al. ..... 166/345
6,053,252 A * 4/2000 Edwards ..... 166/348
6,474,412 B2 * 11/2002 Hamilton et al. ..... 166/77.51

OTHER PUBLICATIONS

International Search Report dated Oct. 4, 2002.

* cited by examiner

*Primary Examiner*—Thomas A Beach
(74) *Attorney, Agent, or Firm*—William E. Hickman

(57) ABSTRACT

A system is disclosed for retrieving a tubular element extending into a subsea well provided with a wellhead, the tubular element being provided with a hanger suspending the tubular element at the wellhead, the hanger having a larger outer diameter than the tubular element. The system comprises a conduit assembly having a passage providing fluid communication between the wellhead and an offshore platform located above the well, the conduit assembly having at least an upper part of internal diameter allowing the tubular element to pass therethrough. The system further includes disconnection means for disconnecting the hanger from the tubular element, and retrieval means for retrieving the tubular element through the conduit assembly to the offshore platform.

14 Claims, 4 Drawing Sheets

18
20
22
12
24
26
28
30
31a
31b
10
4
8
14
16
1
2
3
6

SYSTEM FOR RETRIEVING A TUBULAR ELEMENT FROM A WELL

The present application claims priority on European Patent Application 01304024.1 filed on 2 May 2001.

FIELD OF THE INVENTION

The present invention relates to a system and a method for retrieving a tubular element. More particularly a tubular element extending into a subsea well provided with a wellhead, the tubular element being provided with a hanger suspending the tubular element at the wellhead, the hanger having a larger outer diameter than the tubular element. The tubular element can be, for example, a production tubing for the production of hydrocarbon fluid from a subterranean formation. Such production tubing is near its lower end generally sealed to the wellbore casing by a production packer, and is at its upper end connected to a production tree from which the produced fluids are transported to a storage device.

BACKGROUND OF THE INVENTION

A problem arises if the tubular element has to be retrieved from the well to an offshore platform (such as a floating platform), for example because the tubular element has suffered damage. Since a column of wellbore fluid extending from the platform into the well is needed during retrieval of the tubular element an offshore conduit, also referred to as offshore riser, is to be installed between the platform and the wellhead. Retrieval of the tubular element together with the hanger through the conduit requires the conduit to be of relatively large diameter. Consequently the conduit is heavy, and the platform has to be suited to the heavy conduit.

SUMMARY OF THE INVENTION

The present invention provides for a system and method for retrieving a tubular element extending into a subsea well provided with a wellhead. A tubular element with a hanger is suspended from the wellhead, the hanger having a larger outer diameter than the tubular element.

A conduit assembly in fluid communication between the wellhead and an offshore platform located above the well, the conduit assembly having at least an upper part of internal diameter allowing the tubular element to pass therethrough.

The system for includes means for disconnecting the hanger from the tubular element; and means for retrieving the tubular element through the conduit assembly to the offshore platform.

By disconnecting the hanger from the tubular element and retrieving the tubular element through the conduit assembly without retrieving the hanger, it is achieved that a conduit assembly having at least an upper part of relatively small diameter and consequently lower weight can be applied.

Suitably said upper part of the conduit assembly includes an offshore riser of smaller internal diameter than the outer diameter of the hanger.

In a preferred embodiment the conduit assembly further comprises a lower part of internal diameter allowing the hanger to pass therethrough, whereby the passage in said lower part is in fluid communication with a space for storing the hanger so as to allow the tubular element to pass through the passage in said lower part when the hanger is stored in said space, the system further comprising movement means for moving the hanger into said space.

If, for example, the hanger has a central opening through which the tubular element can pass, the tubular element can be disconnected from the hanger and retrieved through said opening of the hanger and through the conduit assembly to the offshore platform, while the hanger remains at the wellhead.

BRIEF DESCRIPTION OF THE DRAWINGS

The invention will be described hereinafter in more detail and by way of example with reference to the accompanying drawings in which.

In the Figures, like reference numerals relate to like components.

DETAILED DESCRIPTION OF THE PREFERRED EMBODIMENT

Figures 1, 2, 3, 4:
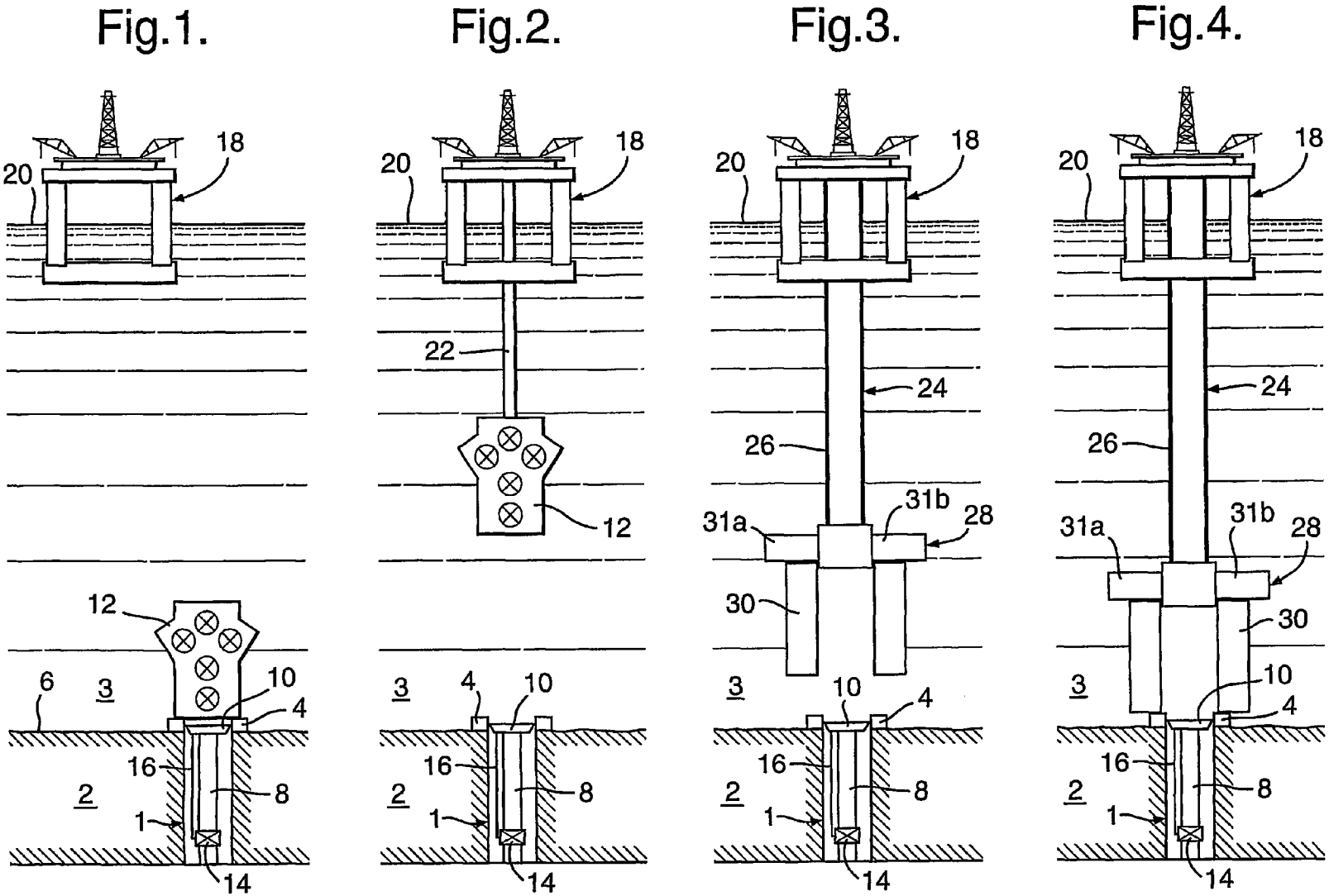
FIGS. 1-16 schematically show an embodiment of the system of the invention during different stages of normal use thereof.

Referring to FIG. 1 there is shown a well 1 formed into an earth formation below a body of seawater 3. The well 1 is provided with a wellhead 4 located at the earth surface 6, a hydrocarbon fluid production tubing 8 extending into the well 1, a tubing hanger 10 which suspends the tubing 8 at the wellhead 4, and a production tree 12 (generally referred to as X-mas tree) arranged on top of the wellhead 4. Furthermore, the tubing 8 is provided with a subsurface safety valve (SSSV) 14 which is controlled by means of a hydraulic control line 16 passing through the tubing hanger 10 to the production tree 12. An offshore platform 18 floats at the water surface 20.

Referring to FIG. 2, the offshore platform 18 is moved to a position above the well 1, the production tree 12 is removed from the wellhead 4 by means of a running string 22.

Referring to FIG. 3, a conduit assembly 24 is lowered from the offshore platform 18 above the wellhead 4. The conduit assembly 24 has a longitudinal through-passage (not shown) and includes an upper part formed of a riser 26, and a lower part formed of a housing 28 and a blowout preventor 30 (BOP). The internal diameter of the riser 26 is larger than the outer diameter of the tubing 8 so that the tubing 8 can pass through the riser 26. The internal diameter of the housing 28 and the BOP 30 is larger than the outer diameter of the tubing hanger 10 so that the tubing hanger 10 can pass through the BOP 30 and the housing 28. The housing 28 is provided with a primary storage chamber 31*a* for storing the tubing hanger 10 and a secondary storage chamber 31*b* in which a replacement tubing hanger (referred to hereinafter) is stored. Alternatively the housing 28 can be provided with several secondary storage chambers, each being provided with a replacement tubing hanger.

Referring to FIG. 4, the BOP 30 is connected to the wellhead 4 so that the passage of the conduit assembly 24 provides fluid communication between the platform 18 and the wellhead 4.

Figure 5:
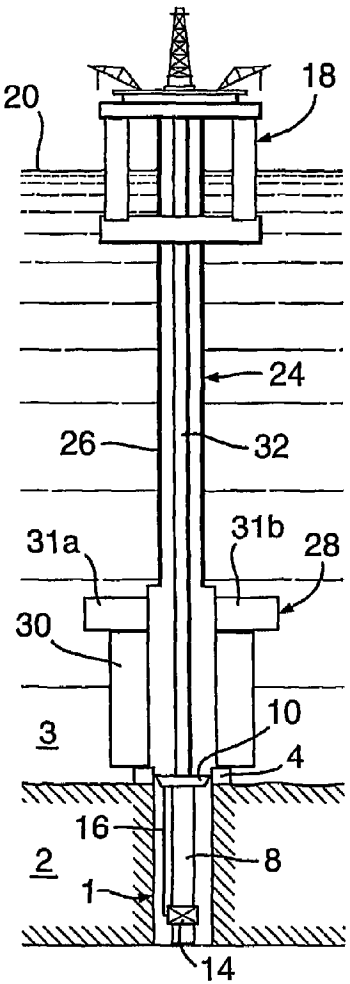

Referring to FIG. 5, a retrieval/running string 32 (e.g. a drill pipe) provided with a latching mechanism for latching the retrieval/running string 32 to the tubing hanger 10 or to the replacement tubing hanger, is lowered through the conduit assembly 24 and latched to the tubing hanger 10. The retrieval/running string is further provided, at the lower end thereof, with a gripper device (not shown) for gripping the tubing 8, for example an internal "fishing spear".

Figure 6:
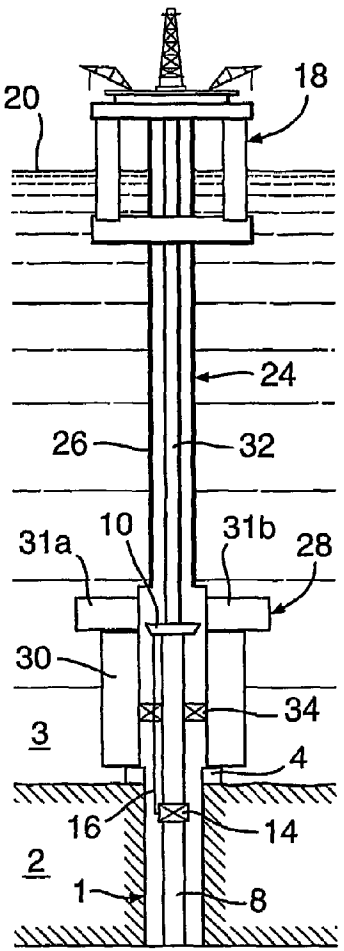

Referring to FIG. 6, the tubing hanger 10 together with the tubing 8 is pulled upwards until the tubing hanger 10 is in the housing 28, and the tubing 8 is suspended from the BOP by closing the BOP rams 34 against the tubing 8.

Figure 7:
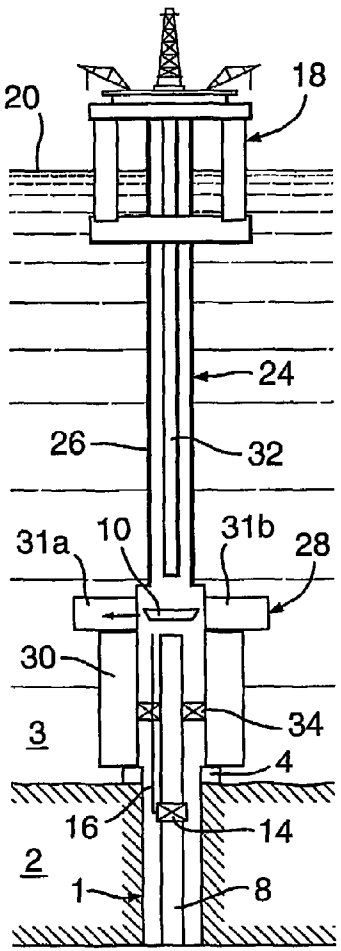

Referring to FIG. 7, a cutter (not shown) arranged in the housing 28 is operated to cut the tubing 8 just below the tubing hanger 10 so as to cut the hanger 10 from the tubing 8. The retrieval/running string 32 is raised a short distance. Instead of being arranged in the housing, the cutter can be lowered through the string 32 so as to cut the tubing 8 from the inside.

Figure 8:
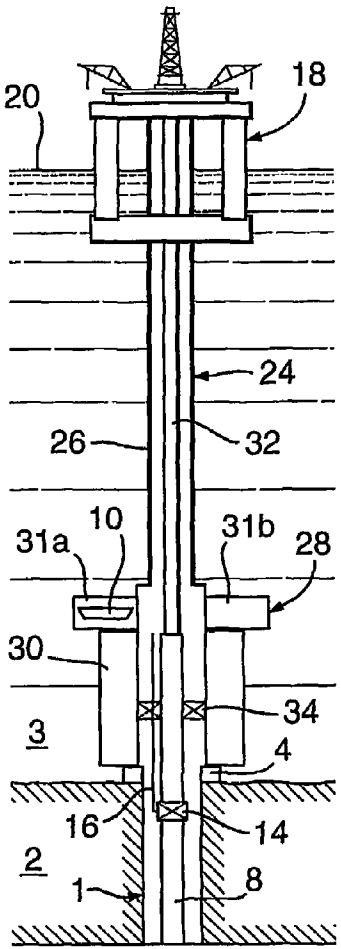

Referring to FIG. 8, the tubing hanger 10 is moved into the primary storage chamber 31*a* by means of a movement device (not shown) provided in the housing 28, and the retrieval/running string 32 is lowered to the upper end of the tubing 8 so as to grip the tubing 8 by means of the gripper device.

Figure 9:
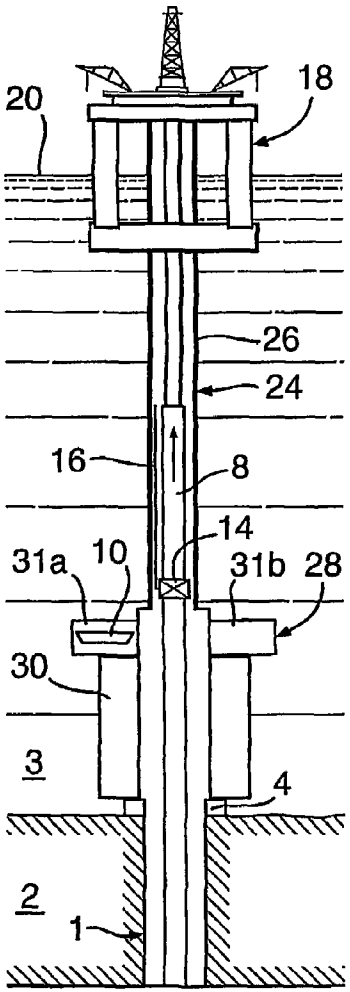

Referring to FIG. 9, the BOP rams 34 are opened and the tubing 8 is pulled out of the well 1 and retrieved to the offshore platform 18 by means of the retrieval/running string 32.

Figure 10:
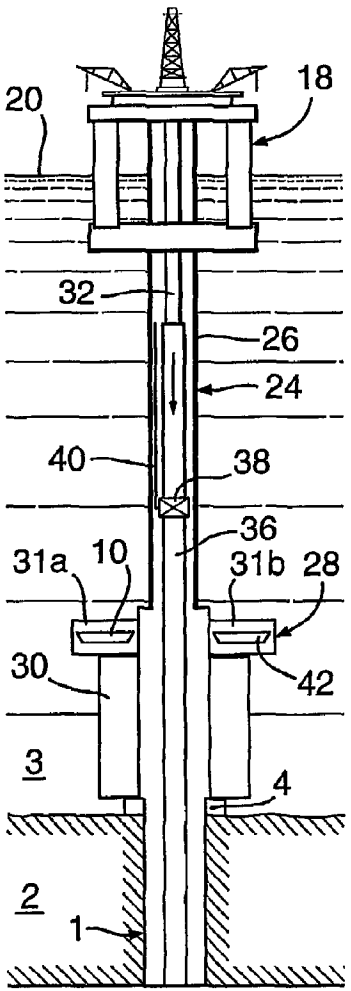

Referring to FIG. 10, a new tubing 36 is lowered from the platform 18 via the conduit assembly 24 into the well 1 by means of the retrieval/running string 32 (or another string). The new tubing is provided with a new SSSV 38 and a corresponding new hydraulic control line 40 capable of latching to the replacement tubing hanger (indicated by reference sign 42). As indicated above, the replacement tubing hanger 42 is stored in the secondary storage chamber 31*b*. The upper end of the new tubing 36 is provided with a latch connector (not shown) for latching the replacement tubing hanger 42 to the new tubing 36.

Figure 11:
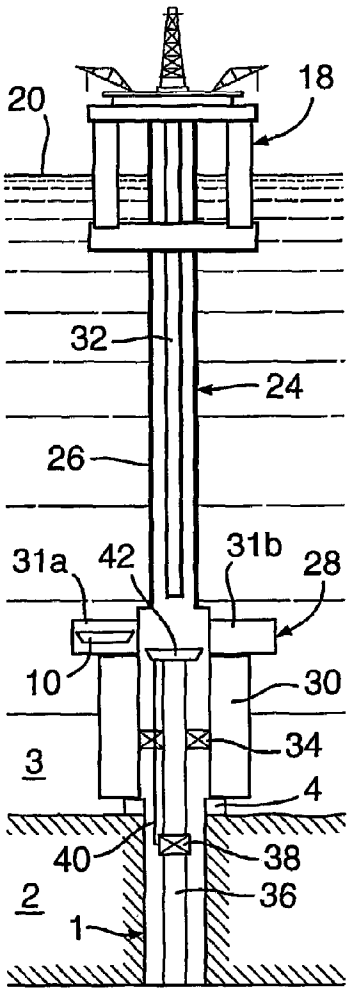

Referring to FIG. 11, lowering of the new tubing 36 proceeds until its upper end is located in the housing 28, whereafter the BOP rams 34 are closed against the new tubing 36 so as to support the new tubing 36. The retrieval/running string 32 is disconnected from the new tubing 36 and raised a short distance, and the movement device moves the replacement tubing hanger 42 from the secondary storage chamber 31*b* into the through-passage of housing 28. The movement device then latches the replacement tubing hanger 42 to the new tubing 36 by means of the latch connector, and the new hydraulic control line 40 latches to the replacement tubing hanger 42.

Figure 12:
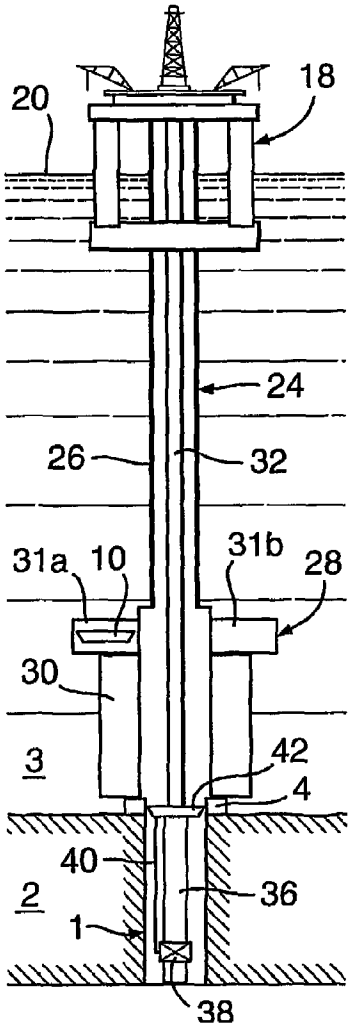

Referring to FIG. 12, the string 32 is lowered so that the latching mechanism of the string 32 latches to the replacement hanger 42. The BOP rams 34 are opened, and the string 32 is further lowered so that the replacement tubing hanger 42 together with the new tubing 36 are lowered through the BOP 30 until the replacement tubing hanger 42 becomes suspended at the wellhead 4.

Figure 13:
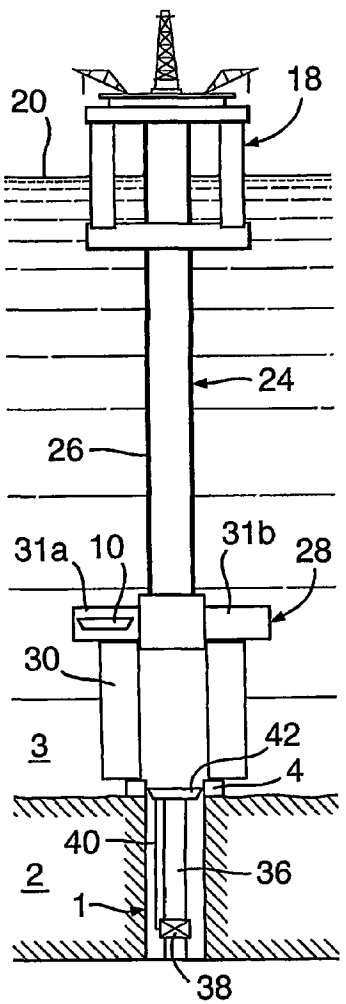

Referring to FIG. 13, the string 32 is unlatched from the replacement tubing hanger 42 and retrieved through the conduit assembly 24 to the offshore platform 18.

Figure 14:
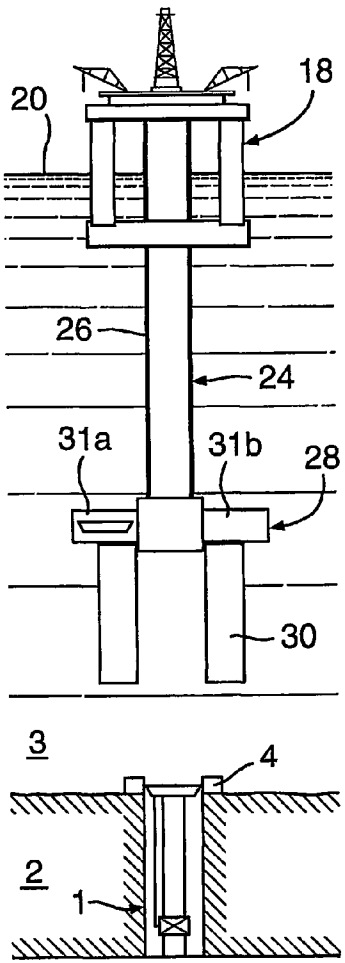

Referring to FIG. 14, the BOP 30 is disconnected from the wellhead 4, and the conduit assembly 24 is retrieved to the offshore platform.

Figure 15:
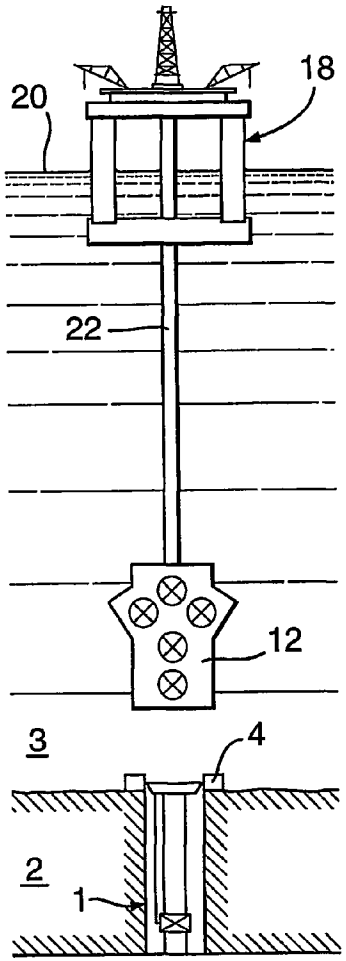
Figure 16:
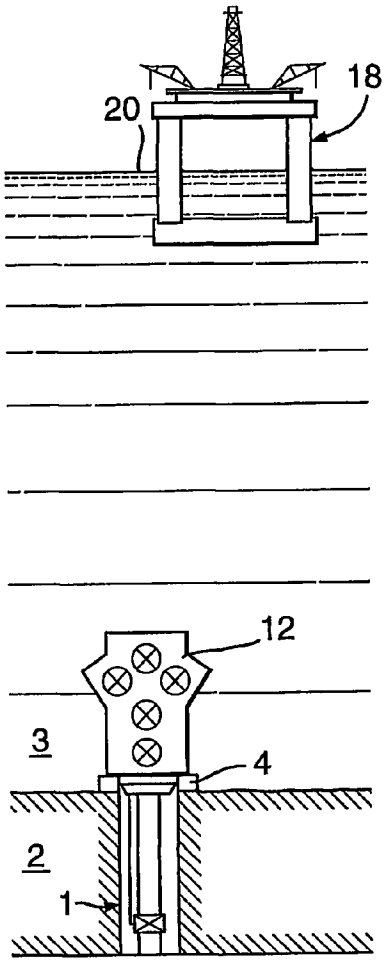

Referring to FIGS. 15 and 16, the production tree 12 is lowered on running string 22 to the wellhead 4 and connected thereto, and the new hydraulic control line 40 is connected to the production tree 12 in conventional manner.

It will be understood that the BOP rams 34 should be adapted to suspend the new tubing 36 without crushing the new hydraulic control line 40. This can, for example, be achieved by a suitable recess provided in the BOP rams 34. Before closing the rams 34 against the new tubing 36, the latter would have to be oriented first so that the new hydraulic control line 40 is located opposite such recess.

While the illustrative embodiments of the invention have been described with particularity, it will be understood that various other modifications will be readily apparent to, and can be easily made by one skilled in the art without departing from the spirit of the invention. Accordingly, it is not intended that the scope of the following claims be limited to the examples and descriptions set forth herein but rather that the claims be construed as encompassing all features which would be treated as equivalents thereof by those skilled in the art to which this invention pertains.

We claim:

1. A system for retrieving a tubular element extending into a subsea well provided with a wellhead, the tubular element being provided with a hanger suspending the tubular element at the wellhead, the hanger having a larger outer diameter than the tubular element, the system comprising:

a conduit assembly having a passage providing fluid communication between the wellhead and an offshore platform located above the well, the conduit assembly comprising at least an upper part of internal diameter allowing the tubular element to pass therethrough;

disconnection means for disconnecting the hanger from the tubular element; and retrieval means for retrieving the tubular element through the conduit assembly to the offshore platform, wherein said upper part of the conduit assembly includes an offshore riser of smaller internal diameter than the outer diameter of the hanger, and wherein the conduit assembly further comprises a lower part which lower part is connected to the wellhead;

wherein the lower part is a lower part of internal diameter allowing the hanger to pass therethrough, whereby the passage in said lower part is in fluid communication with a space for storing the hanger so as to allow the tubular element to pass through the passage in said lower part when the hanger is stored in said space.

2. The system of claim 1, wherein said lower part of the conduit assembly includes a housing through which said passage extends, the housing being provided with a storage chamber defining said space.

3. The system of claim 2, wherein said storage chamber is a primary storage chamber, and wherein the housing is further provided with at least one secondary storage chamber, each secondary storage chamber being provided with a respective replacement hanger.

4. The system of claim 2, wherein said lower part of the conduit assembly further includes a blowout preventor (BOP) through which said passage extends, the BOP being arranged below said housing.

5. The system of claim 1, wherein the disconnecting means is selected from a cutter for cutting the hanger from the tubular element and a device for unscrewing the hanger from the tubular element.

6. The system of claim 5, wherein the cutter is a jet cutter operable to cut the tubular element by a stream of fluid jetted from the jet cutter.

7. The system of claim 5, wherein the disconnecting means comprises an elongate member extending through said upper conduit part, the elongate member being provided with said one of a cutter and a device for unscrewing the hanger from the tubular element.

8. The system of claim 1, wherein the tubular element is a tubing for the production of hydrocarbon fluid from the well.

9. The system of claim 3, wherein said lower part of the conduit assembly further includes a blowout preventor (BOP) through which said passage extends, the BOP being arranged below said housing.

10. The system of claim 1, wherein the disconnecting means is selected from a cutter for cutting the hanger from the tubular element and a device for unscrewing the hanger from the tubular element.

11. The system of claim 2, wherein the disconnecting means is selected from a cutter for cutting the hanger from the tubular element and a device for unscrewing the hanger from the tubular element.

12. The system of claim 6, wherein the disconnecting means comprises an elongate member extending through said upper conduit part, the elongate member being provided with said one of a cutter and a device for unscrewing the hanger from the tubular element.

13. A method of retrieving a tubular element extending into a subsea well provided with a wellhead, the tubular element being provided with a hanger suspending the tubular element at the wellhead, the hanger having a larger outer diameter than the tubular element, the method comprising:

installing a conduit assembly having a passage so that the passage provides fluid communication between the wellhead and an offshore platform located above the well, the conduit assembly comprising at least an upper part of internal diameter allowing the tubular element to pass therethrough and a lower part which is connected to the wellhead;

disconnecting the hanger from the tubular element; and retrieving the tubular element through the conduit assembly to the offshore platform wherein said upper part of the conduit assembly includes an offshore riser of smaller internal diameter than the outer diameter of the hanger.

14. A method of retrieving a tubular element extending into a subsea well provided with a wellhead, the tubular element being provided with a hanger suspending the tubular element at the wellhead, the hanger having a larger outer diameter than the tubular element, the method comprising:

installing a conduit assembly having a passage so that the passage provides fluid communication between the wellhead and an offshore platform located above the well, the conduit assembly comprising at least an upper part of internal diameter allowing the tubular element to pass therethrough and a lower part which is connected to the wellhead;

disconnecting the hanger from the tubular element: and retrieving the tubular element through the conduit assembly to the offshore platform wherein said upper part of the conduit assembly includes an offshore riser of smaller internal diameter than the outer diameter of the hanger;

wherein the lower part is a lower part of internal diameter allowing the hanger to pass therethrough, whereby the passage in said lower part is in fluid communication with a space for storing the hanger so as to allow the tubular element to pass through the passage in said lower part when the hanger is stored in said space, the conduit assembly including movement means for moving the hanger into said space, and wherein the method further comprises moving the hanger through said lower part of the conduit assembly and from there into space using the movement means.

* * * * *